United States Patent [19]

Yamato

[11] Patent Number: 4,512,321

[45] Date of Patent: Apr. 23, 1985

[54] FUEL SUPPLY CONTROL METHOD FOR MULTI CYLINDER INTERNAL COMBUSTION ENGINES AFTER TERMINATION OF FUEL CUT

[75] Inventor: Akihiro Yamato, Shiki, Japan

[73] Assignee: Honda Giken Kogyo Kabushiki Kaisha, Tokyo, Japan

[21] Appl. No.: 608,998

[22] Filed: May 10, 1984

[30] Foreign Application Priority Data

Jun. 15, 1983 [JP] Japan ..... 58-107548

[51] Int. Cl.[3] ..... F02M 51/00

[52] U.S. Cl. ..... 123/493; 123/326

[58] Field of Search ..... 123/493, 492, 478, 480, 123/326

[56] References Cited

U.S. PATENT DOCUMENTS

| | | | |
|---|---|---|---|
| 3,736,910 | 6/1973 | Raff | 123/493 |
| 4,311,123 | 1/1982 | Glöckler et al. | 123/493 |
| 4,452,212 | 6/1984 | Takase | 123/326 |
| 4,459,962 | 7/1984 | Yamato et al. | 123/493 |
| 4,466,411 | 8/1984 | Hasegawa et al. | 123/480 |

FOREIGN PATENT DOCUMENTS 0145819 11/1979 Japan ..... 123/493

*Primary Examiner*—Parshotam S. Lall

*Attorney, Agent, or Firm*—Arthur L. Lessler

[57] ABSTRACT

A method of sequentially injecting fuel into the cylinders of a multi cylinder internal combustion engine in predetermined sequence in synchronism with generation of pulses of a trigger signal, wherein the quantity of fuel to be injected into each cylinder is set to a value appropriate to an operating condition of the engine then detected, upon generation of each pulse of the same signal, and the fuel supply to each cylinder is interrupted when the engine is decelerating in a predetermined operating condition. When it is determined that a predetermined condition for terminating the interruption of the fuel supply to the engine is satisfied, one of the above sequential injections is effected into a cylinder corresponding to a present pulse of the trigger signal at the time of generation of a present pulse of the same signal, and simultaneously an additional injection is effected into another cylinder corresponding to a preceding pulse of the trigger signal. Preferably, the quantity of fuel to be injected by the additional injection is set to be a value substantially equal to that by the above one of the sequential injections.

5 Claims, 4 Drawing Figures

FUEL SUPPLY CONTROL METHOD FOR MULTI CYLINDER INTERNAL COMBUSTION ENGINES AFTER TERMINATION OF FUEL CUT

BACKGROUND OF THE INVENTION

This invention relates to a fuel supply control method for multi cylinder internal combustion engines, and more particularly to a method of this kind which is adapted to control the fuel supply to the engine immediately after termination of a fuel cut operation which is effected at deceleration of the engine.

In conventional fuel supply control methods of electrically controlling the quantity of fuel to be injected into an internal combustion engine, the fuel supply to the engine is generally interrupted (hereinafter called "fuel cut") while the engine is decelerating with the throttle valve fully closed, until the rotational speed of the engine drops below a predetermined rpm value, to thereby improve the fuel consumption of the engine. This predetermined rpm value at which the engine is recovered to a normal fuel supply-requiring condition from a fuel cut effecting condition is desirably set at a value as close to the the idling rpm (e.g. 750 rpm) of the engine as possible, for improvement of the fuel consumption of the engine.

However, the engine cannot promptly produce torque immediately after the termination of a fuel cut operation due to a time lag between the time fuel is supplied to the cylinders and the time combustion of fuel thus supplied takes place in the cylinders to produce torque, even if the fuel supply to the engine is started immediately after the engine speed has decreased below the above predetermined rpm value. Therefore, if the predetermined rpm value is set at a value substantially equal to the idling rpm, the engine speed can drop to a large extent, often resulting in engine stall, during the above time lag, i.e. from the time a fuel cut operation is terminated to the time torque is produced by the engine, when load-creating equipments such as power steering are operated with the clutch maintained in an off state during the fuel cut operation.

In order to avoid such engine stall caused by the operation of the load-creating equipments, the above predetermined rpm value employed to determine whether or not fuel cut should be terminated has to be set at a value much higher than the idling rpm of the engine, e.g. at a value of 1200 rpm. However, the use of such high predetermined rpm value hinders satisfactory improvement of the fuel consumption of the engine.

SUMMARY OF THE INVENTION

It is the object of the invention to provide a fuel supply control method for a multi cylinder internal combustion engine, which is capable of minimizing the time lag in the supply of a first batch of fuel to the engine immediately after the termination of a fuel cut operation of the engine, making it possible to set the predetermined rpm value for determining the termination of a fuel cut operation at a value closer to the idling rpm of the engine, to thereby improve the fuel consumption of the engine.

The present invention provides a method of controlling the supply of fuel to an internal combustion engine having a plurality of cylinders at deceleration thereof, wherein operating conditions of the engine are detected, the quantity of fuel to be supplied to the engine is set to a value appropriate to a detected operating condition of the engine upon generation of each pulse of a trigger signal, sequential injections of the set quantity of fuel are effected into the cylinders in predetermined sequence in synchronism with generation of pulses of the trigger signal, and the fuel supply to the cylinders is interrupted when the engine is decelerating in a predetermined operating condition.

The method according to the invention is characterized by comprising the following steps: (1) determining whether or not a predetermined condition for terminating the interruption of the fuel supply to the engine is satisfied; and (2) when said predetermined condition is determined to be satisfied, effecting one of the sequential injections into one of the cylinders which corresponds to a present pulse of the trigger signal at the time of generation of the present pulse of the same signal, and simultaneously effecting an additional injection into another one of the cylinders which corresponds to an immediately preceding pulse of the trigger signal.

Preferably, the sequential injections are each started at a crank angle position of the engine falling within a range from 30 to 180 degrees before the start of a suction stroke of a corresponding one of the engine cylinders. Also preferably, the rotational speed of the engine is detected, and when the detected rotational speed of the engine is lower than a predetermined value, it is determined that the predetermined condition for terminating the interruption of the fuel supply is satisfied.

Preferably, the above additional injection is effected when the detected rotational speed of the engine is lower than the predetermined value and at the same time a detected rate of decrease in the engine rotational speed is larger than a predetermined value. Also preferably, the quantity of fuel to be injected by the additional injection is set to a value substantially equal to that by the one of the sequential injections.

The above and other objects, features and advantages of the invention will be more apparent from the ensuing detailed description taken in conjunction with the accompanying drawings.

DETAILED DESCRIPTION

The present invention will now be described in detail with reference to the drawings.

Figure 1:
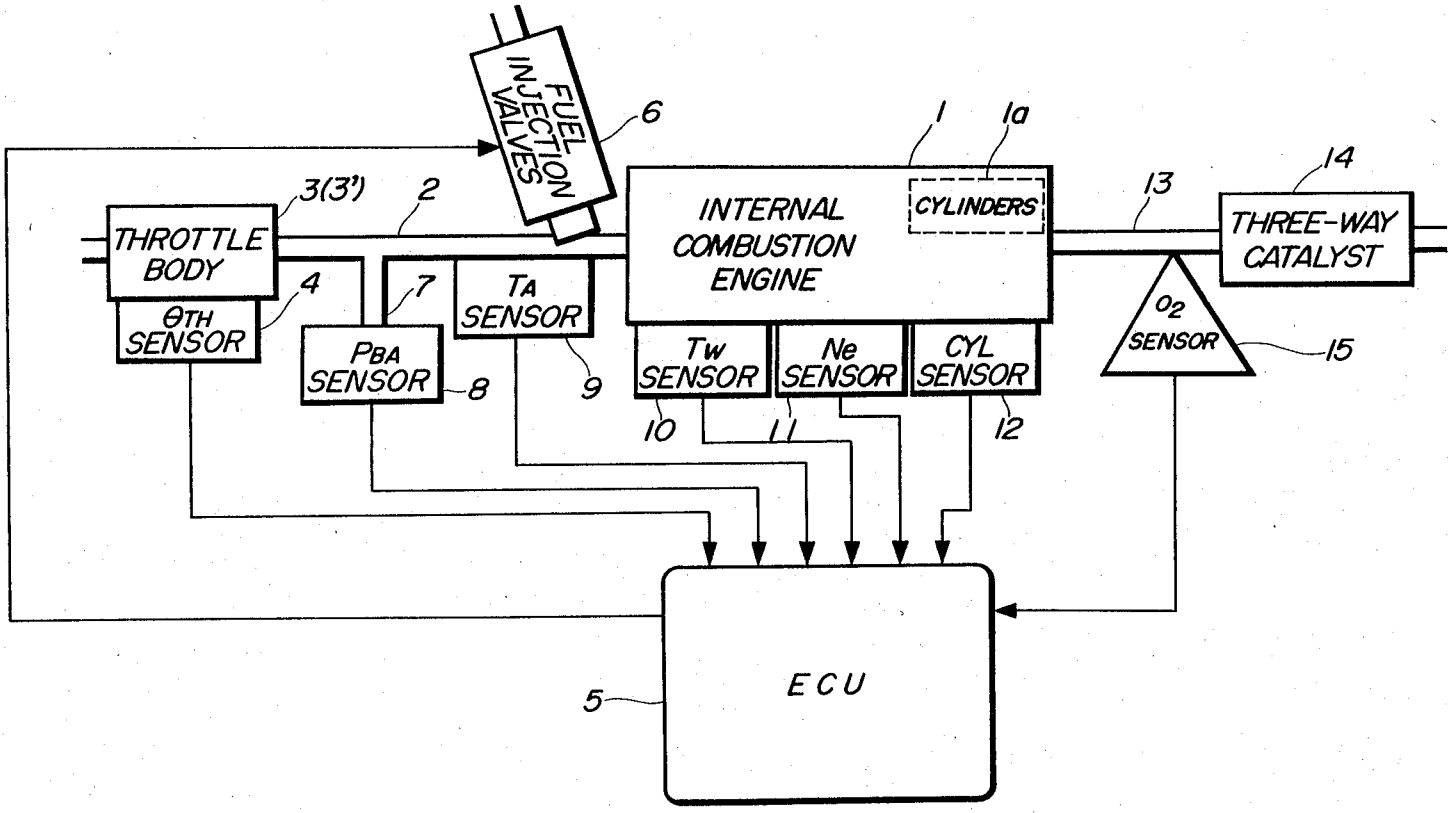
FIG. 1 is a view schematically illustrating the whole arrangement of a fuel supply control system to which is applied the method according to the invention.

Referring first to FIG. 1, there is illustrated an example of the whole arrangement of a fuel supply control system for internal combustion engines, to which the method according to the present invention is applied. Reference numeral 1 designates a multi cylinder internal combustion engine which has four cylinders 1*a* for instance, and to which is connected an intake pipe 2 with a throttle valve 3' in a throttle body 3 arranged therein. A throttle valve opening (θTH) sensor 4 is connected to the throttle valve 3' for detecting its valve opening and is electrically connected to an electronic control unit (hereinafter called "the ECU") 5, to supply same with an electrical signal indicative of throttle valve opening detected thereby.

Fuel injection valves 6 are arranged in the intake pipe 2 each at a location slightly upstream of an intake valve, not shown, of a corresponding one of the engine cylinders 1*a*, and between the engine 1 and the throttle valve 3', for supplying fuel into the corresponding engine cylinder. The fuel injection valves 6 are connected to a fuel pump, not shown, and electrically connected to the ECU 5, in a manner having their valve opening periods or fuel injection quantities controlled by driving signals supplied from the ECU 5.

On the other hand, an absolute pressure (PBA) sensor 8 communicates through a conduit 7 with the interior of the intake pipe 2 at a location downstream of the throttle valve 3'. The absolute pressure sensor 8 is adapted to detect absolute pressure in the intake pipe 2 and supplies an electrical signal indicative of detected absolute pressure to the ECU 5.

An engine rotational speed sensor (hereinafter called "the Ne sensor") 11 and a cylinder-discriminating sensor (hereinafter called "the CYL sensor") 12 are arranged on a crankshaft, not shown, of the engine 1 or a camshaft, not shown, of same. The former 11 is adapted to generate one pulse at a particular crank angle each time an engine crankshaft rotates through 180 degrees, while the latter 12 is adapted to generate one pulse at a particular crank angle of a particular engine cylinder, i.e. one pulse per two rotations of the crankshaft. The above pulses generated by the sensors 11, 12 are supplied to the ECU 5.

An engine temperature sensor (hereinafter called "the TW sensor") 10 is mounted in the cylinder block of the engine 1 for detecting the temperature (TW) of engine cooling water as engine temperature, and an intake air temperature sensor (hereinafter called "the TA sensor") 9 is arranged in the intake pipe 2 for detecting intake air temperature. Electrical output signals from these sensors 10, 9 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of detected oxygen concentration to the ECU 5.

Further connected to the ECU 5 are a sensor for detecting atmospheric pressure (PA), a starter switch for actuating the starter of the engine 1, and a battery, none of which is shown, for supplying the ECU 5 with electrical signals indicative, respectively, of detected atmospheric pressure, its own on and off positions, and output voltage from the battery.

The ECU 5 operates on the basis of the various engine operation parameter signals inputted thereto from the sensors referred to above to calculate the valve opening period TOUT of the fuel injection valves 6 by means of the following equation:

$$TOUT = Ti \times K1 + K2 \quad (1)$$

wherein Ti represents a basic value of the fuel injection period of the fuel injection valves 6 and is read from a storage means within the ECU 5 as a function of the intake pipe absolute pressure PBA and the engine speed Ne, and K1 and K2 represent correction coefficients or variables having their values calculated, by respective predetermined equations, on the basis of the values of signals from the aforementioned various sensors, that is, the throttle valve opening (θTH) sensor 4, the intake pipe absolute pressure sensor 8, the Ne sensor 11, the TW sensor 10, the intake air temperature sensor 9, the atmospheric pressure sensor, etc., so as to optimize the startability, emission characteristics, fuel consumption, accelerability, etc. of the engine. The valve opening period TOUT of the fuel injection valves 6 is set to zero when the engine is operating in a fuel cut effecting region.

The ECU 5 supplies driving signals to the fuel injection valves 6 to open same for the valve opening period TOUT calculated by the use of the above equation.

Figure 2:
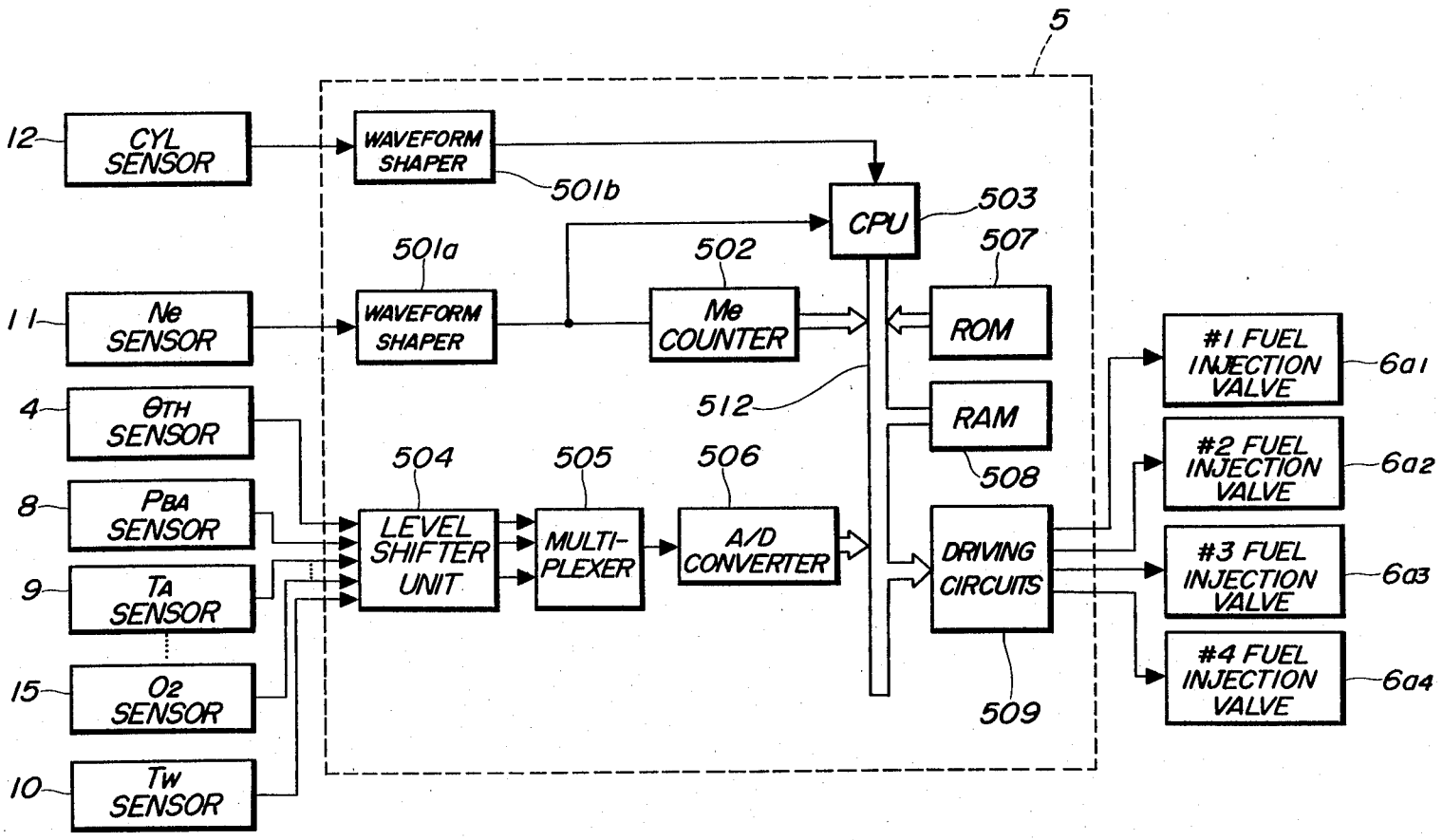
FIG. 2 is a circuit diagram showing the internal arrangement of an electronic control unit appearing in FIG. 1.
Figure 4:
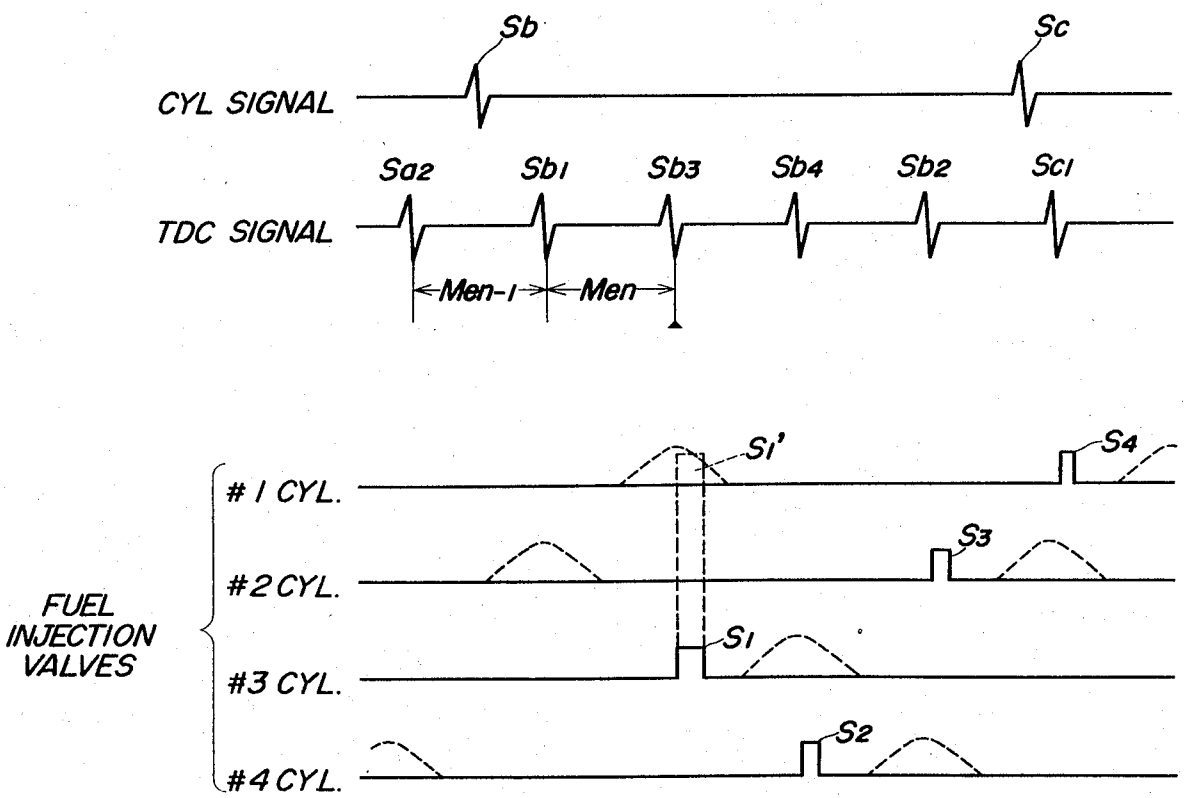
FIG. 4 is a timing chart showing the relationship in timing between a cylinder-discriminating (CYL) signal, a TDC signal, and driving signals for fuel injection valves, and also showing a manner of effecting the additional injection according to the invention.

FIG. 2 shows an electrical circuit within the ECU 5 in FIG. 1. The Ne sensor 11 in FIG. 1 generates a trigger signal (hereinafter called "the TDC signal") having its pulses generated at a predetermined crank angle of each one of the engine cylinders in predetermined sequence corresponding to the sequence of actions of the engine cylinders, as shown in FIG. 4. For instance, each pulse of the TDC signal is generated when the piston in the corresponding cylinder is in a position in advance of its top-dead-center position and before the starting point for its suction stroke, by a predetermined crank angle falling within a range between 30 and 180 degrees, preferably between 60 and 90 degrees. The TDC signal is supplied to a waveform shaper 501*a* to have its pulse waveform shaped, and then applied to a central processing unit (hereinafter called "the CPU") 503 as well as to an Me counter 502. The Me counter 502 counts the interval of time between a preceding pulse of the TDC signal from the Ne sensor 11 and a present pulse of the same signal, and accordingly its counted value Me is proportional to the reciprocal of the actual engine speed Ne. The Me counter 502 supplies the counted value Me to the CPU 503 via a data bus 512.

The respective output signals from the throttle valve opening (θTH) sensor 4, the intake pipe absolute pressure (PBA) sensor 8, the intake air temperature sensor 9, the $O_2$ sensor 15, the engine temperature (TW) sensor 10, all appearing in FIG. 1, and other engine parameter sensors have their voltage levels shifted to a predetermined voltage level by a level shifter unit 504 and successively applied to an analog-to-digital converter (hereinafter called "the A/D converter") 506 through a multiplexer 505. The A/D converter 506 successively converts the above signals into digital signals and supplies them to the CPU 503 via the data bus 512.

The CYL sensor 12 generates a cylinder-discriminating signal having its pulses generated at a predetermined crank angle of a particular engine cylinder, for instance, a first cylinder (Sb and Sc in FIG. 4). The output signal from the CYL sensor 12 has its waveform shaped by another waveform shaper 501*b*, and then applied to the CPU 503.

Also connected to the CPU 503 are a read-only memory (hereinafter called "the ROM") 507, a random access memory (hereinafter called "the RAM") 508, and driving circuits 509, through the data bus 512. The RAM 508 temporarily stores the resultant values of various calculations from the CPU 503, while the ROM 507 stores a control program to be executed by the CPU 503, a predetermined rpm value NFCT1L for determining the termination of a fuel cut operation of the engine, hereinafter referred to, etc.

The CPU 503 executes the control program stored in the ROM 507 to determine operating conditions of the engine as well as loaded conditions of same in response to values of the aforementioned various engine parameter signals, and to calculate the valve opening period TOUT for the fuel injection valves 6a1–6a4 arranged in first to fourth cylinders of the engine, respectively, on the basis of the determined operating conditions and loaded conditions of the engine. The CPU 503 supplies the calculated TOUT value to each one of the driving circuits 509 as a control signal, via the data bus 512. The driving circuits 509 sequentially supply driving signals (S1–S4 in FIG. 4) to the respective fuel injection valves 6a1–6a4 to open same, as long as they are supplied with the above control signals from the CPU 503.

Figure 3:
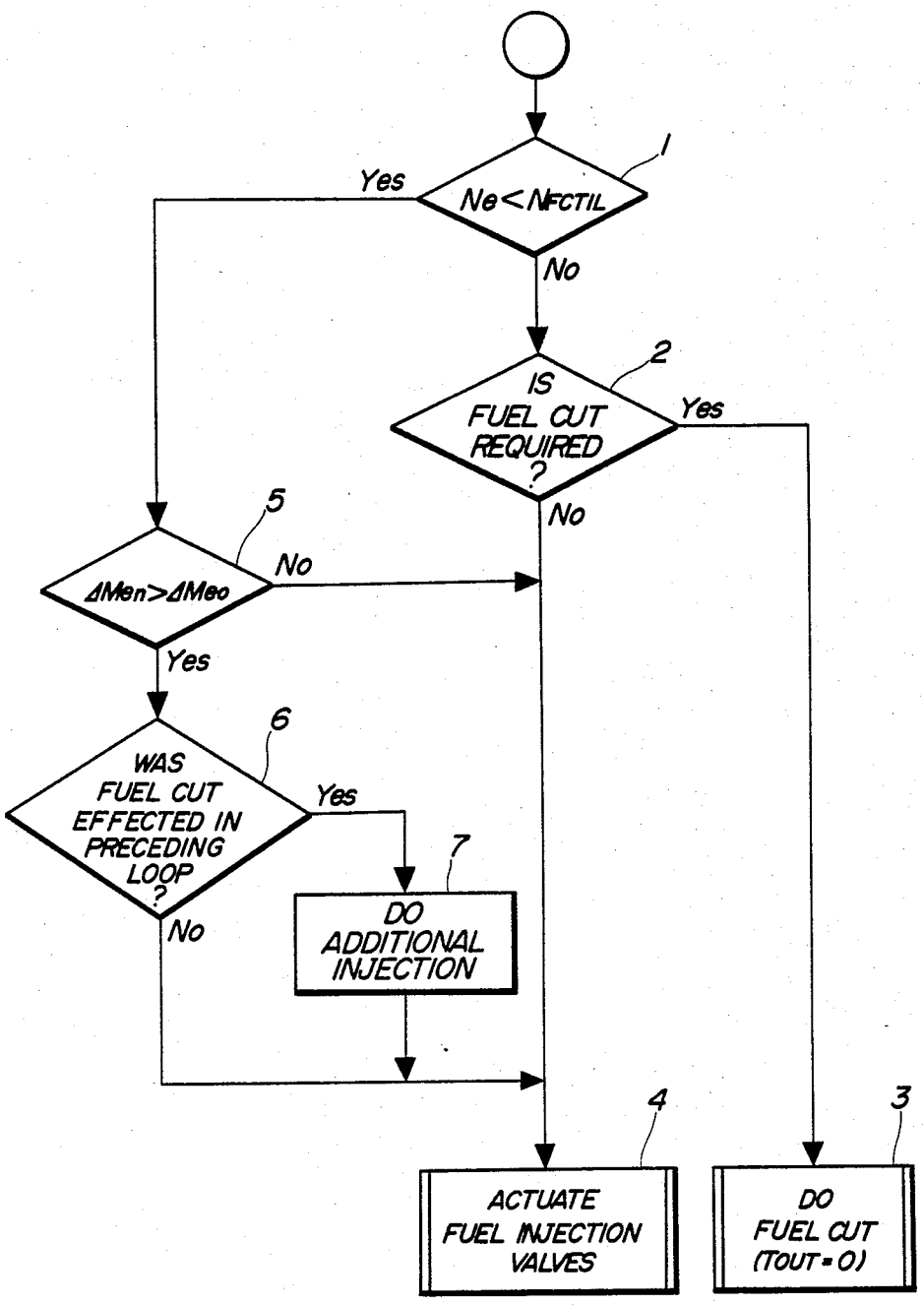
FIG. 3 is a flow chart showing a manner of determining execution of the additional fuel injection immediately following the termination of a fuel cut operation, according to the invention.

FIG. 3 shows a flow chart of a fuel supply control program according to the invention, which is called from the ROM 507 and executed within the CPU 503 in synchronism with generation of pulses of the TDC signal. The method of the invention will now be described with reference to the flow chart of FIG. 3 as well as to the timing chart of FIG. 4.

First, at the step 1 in FIG. 3, a determination is made as to whether or not the actual rotational speed Ne of the engine is lower than the predetermined rpm value NFCT1L, to thereby determine whether or not one of conditions is satisfied for terminating a fuel cut operation of the engine. The actual engine speed Ne used in the determination at the step 1 is calculated in the following manner: Referring to FIG. 4, assuming that the present loop is executed immediately after generation of a pulse Sb3 of the TDC signal, the engine speed Ne for the present loop is calculated from the count value Men counted by the Me counter 502 in FIG. 2 and indicative of the time interval between the present pulse Sb3 of the TDC signal and an immediately preceding pulse Sb1 of the same signal. On the other hand, the predetermined rpm value NFCT1L is set at a value slightly higher than the idling rpm of the engine, for instance, it is set at 850 rpm.

If the condition of engine speed for terminating a fuel cut operation is not satisfied (i.e. $Ne \geqq NFCT1L$), that is, if the answer to the question at the step 1 is no, it is then determined whether or not the engine is operating in a condition requiring fuel cut, on the basis of other engine operation parameters such as the intake pipe absolute pressure and the throttle valve opening, at the step 2. If the answer is yes, the valve opening period TOUT of the fuel injection valves 6a1–6a4 is set to zero to carry out fuel cut, at the step 3.

If the determination at the step 2 provides a negative answer (no), that is, when the engine is not operating in a condition requiring fuel cut, the program proceeds to the step 4 to actuate the fuel injection valves 6a1–6a4. In this step 4, the fuel injection valves 6a1–6a4 arranged in the respective engine cylinders are each supplied with a driving signal generated in synchronism with a pulse of the TDC signal corresponding to its associated engine cylinder, and are sequentially actuated in predetermined sequence to carry out ordinary or sequential injections of fuel into the respective engine cylinders. The ordinary sequential injections are each started when the piston in the corresponding cylinder is in a crank angle position falling within a range between 30 and 180 degrees, preferably between 60 and 90 degrees before the starting point for its suction stroke. The relationship in timing between the fuel injection and the start of suction stroke is determined by the construction and configuration of an engine to be applied.

If the answer to the question at the step 1 is yes, that is, when the engine rotational speed Ne is lower than the predetermined rpm value NFCT1L, the program proceeds to the step 5 to determine whether or not the rate of decrease in the engine speed Ne is larger than a predetermined value ΔMe0. The rate of decrease in the engine speed Ne is calculated as a difference ΔMen between the counted value Men counted by the Me value counter 502 in FIG. 2 upon generation of the present pulse Sb3 of the TDC signal, and the counted value Men-1 counted upon generation of the preceding pulse Sb1 of the same signal (i.e. $\Delta Men = Men - Men - 1$). Thus, at the step 5, it is determined whether or not this difference ΔMen is larger than the predetermined value ΔMe0 (e.g. 3 ms).

If the answer to the question at the step 5 is no, that is, when the rate of decrease in the engine speed Ne is smaller than the predetermined value ΔMe0, the program proceeds to the step 4 to effect the aforementioned ordinary sequential injections alone into the respective cylinders. This is because when the rate of decrease in the engine speed Ne is small, there is no fear of engine stall even if an additional injection, hereinafter referred to, is not effected into a corresponding cylinder and even when the fuel cut terminating condition is satisfied for the first time in the present loop.

If the answer to the question of the step 5 is yes, that is,, when the engine speed Ne is lower than the predetermined rpm value NFCT1L and at the same time the rate of decrease in the engine speed Ne is larger than the predetermined value ΔMe0, it is determined at the step 6 whether or not fuel cut was effected in the preceding loop. If the answer is no, that is, when the fuel supply to the engine was already effected at the time of generation of the preceding pulse of the TDC signal, and accordingly the present TDC pulse is not a first pulse generated after the termination of a fuel cut operation, the program proceeds to the step 4 to actuate the fuel injection valves.

If the answer to the question of the step 6 is yes, it is judged that the present loop is the first loop to be executed after the termination of a fuel cut operation, and the step 7 is executed to effect an additional injection into an engine cylinder corresponding to the preceding pulse Sb1 of the TDC signal (the #1 cylinder in FIG. 4), which is yet in a position before or during suction stroke thereof at the time of generation of the present pulse Sb3 of the TDC signal. At the same time, one of the ordinary sequential injections is effected into a cylinder corresponding to the present pulse Sb3 of the TDC signal (the #3 cylinder in FIG. 4), at the step 4. That is, while in the ordinary injections, conventionally the fuel supply to the #3 cylinder alone is effected upon generation of the present pulse Sb3 of the TDC signal, the driving signal S1 for actuating the #3 fuel injection valve is also supplied to the #1 fuel injection valve as a driving signal S1′ (the broken line in FIG. 4) when it is determined that the fuel cut terminating condition is satisfied, to thereby supply the #1 cylinder in addition to the #3 cylinder with the same quantity of fuel according to the present invention.

In this manner, when the fuel cut terminating condition is determined to be satisfied, fuel supply is effected not only into the #3 cylinder corresponding to the present pulse Sb3 of the TDC signal, but also into the #1 cylinder corresponding to the TDC pulse Sb1 immediately preceding the present pulse Sb3 and whose combustion stroke should take place in advance of one in the #3 cylinder earlier by one TDC signal pulse, which is in a crank angle position immediately before or during suction stroke thereof at the time of generation of the present pulse Sb3 of the TDC signal, thereby making it possible to produce engine torque earlier by one pulse of the TDC signal at the time of recovery of engine operation from a fuel cut effecting condition. By virtue of the advanced generation of engine torque immediately after the termination of a fuel cut operation, the aforementioned predetermined rpm value NFCT1L employed to determine whether or not a fuel cut operation should be terminated can be set at a smaller value.

The method of the present invention can be applied to any type of internal combustion engine insofar as it is adapted to start one of the ordinary injections when the piston in the corresponding engine cylinder is in a crank angle position falling within a range between 30 and 180 degrees, preferably 60 and 90 degrees, before the start of suction stroke thereof, to effect an additional injection into a cylinder corresponding to a preceding pulse of the TDC signal, upon generation of a present pulse of the TDC signal.

During fuel cut operation of the engine, the phenomenon can occur that fuel adhering to the inner wall of the intake pipe is vaporized to cause the air-fuel ratio of a mixture supplied to the engine to become too lean after the termination of the fuel cut operation. To avoid this, an increased quantity of fuel may be supplied to the cylinders immediately after the termination of a fuel cut operation until a predetermined number of pulses of the TDC signal are generated after the termination of the fuel cut operation, so as to compensate for the fuel vaporized during the fuel cut operation, thus preventing engine stall due to too lean an air-fuel mixture on such occasion.

Although, at the step 5 of FIG. 3, it is determined whether or not the rate of decrease in the engine speed Ne is larger than the predetermined value to determine whether or not an additional injection according to the invention should be effected at the step 7, the determination of the step 5 may be omitted, and instead, such additional injection may be effected when the engine speed Ne is lower than the predetermined value NFCT1L and at the same time the present loop is determined to be the first loop to be executed after the termination of a fuel cut operation. Further, according to the FIG. 3 embodiment, the determination as to whether or not fuel cut should be terminated is effected upon generation of each pulse of the TDC signal. However, the timing of the determination is not limited to the above manner. For instance, the same determination may alternatively be effected upon generation of each pulse of an interrupt signal generated between adjacent pulses of the TDC signal, and an additional injection is effected upon generation of a first pulse of the TDC signal generated immediately after the generation of a pulse of the interrupt signal when the termination of a fuel cut operation is determined for the first time.

What is claimed is:

1. A method of controlling the supply of fuel to an internal combustion engine having a plurality of cylinders at deceleration thereof, wherein operating conditions of said engine are detected, the quantity of fuel being supplied to said engine is set to a value appropriate to a detected operating condition of said engine upon generation of each pulse of a trigger signal, sequential injections of the set quantity of fuel are effected into said cylinders in predetermined sequence in synchronism with generation of pulses of said trigger signal, and the supply of fuel to said cylinders is interrupted when said engine is decelerating in a predetermined operating condition, the method comprising the steps of: (1) determining whether or not a predetermined condition for terminating the interruption of the fuel supply to said engine is satisfied; and, (2) when said predetermined condition is determined to be satisfied, effecting one of said sequential injections into one of said cylinders which corresponds to a present pulse of said trigger signal at the time of generation of said present pulse of said trigger signal, and simultaneously effecting an additional injection into another one of said cylinders which corresponds to an immediately preceding pulse of said trigger signal.

2. A method as claimed in claim 1, including the step of detecting the rotational speed of said engine, and wherein it is determined that said predetermined condition for terminating the interruption of the fuel supply is satisfied when the detected rotational speed of said engine is lower than a predetermined value.

3. A method as claimed in 2, including the step of detecting the rate of decrease in the rotational speed of said engine, and wherein said additional injection is effected when the detected rotational speed of said engine is lower than said predetermined value and at the same time the detected rate of decrease in the rotational speed of said engine is larger than a predetermined value.

4. A method as claimed in claim 1, wherein said sequential injections are each started at a crank angle position of said engine falling within a range from 30 to 180 degrees before the start of a suction stroke of a corresponding one of said cylinders.

5. A method as claimed in claim 1, wherein the quantity of fuel to be injected by said additional injection is set to a value substantially equal to the quantity of fuel to be injected by said one of said sequential injections.

* * * * *